US005505664A

United States Patent [19]

Nolan et al.

[11] Patent Number: 5,505,664

[45] Date of Patent: Apr. 9, 1996

[54] ARTICULATED SWING

[75] Inventors: Robert J. Nolan, Columbus, Miss.; Paul C. Gilles, Bedford, Pa.

[73] Assignee: Hedstrom Corporation, Bedford, Pa.

[21] Appl. No.: 306,303

[22] Filed: Sep. 14, 1994

[51] Int. Cl.[6] ..... A63G 9/16

[52] U.S. Cl. ..... 472/120; 472/118; 472/125; 297/245; 297/247

[58] Field of Search ..... 472/118, 120, 472/124, 125; 297/243, 244, 245, 247, 273

[56] References Cited

U.S. PATENT DOCUMENTS

| | | | |
|---|---|---|---|
| 2,772,722 | 12/1956 | Paumen | 472/120 |
| 2,812,011 | 11/1957 | Jansson | 472/120 |
| 4,190,248 | 2/1980 | Philippi | 472/120 |
| 4,570,928 | 2/1986 | Smith | 472/120 |
| 4,961,558 | 10/1990 | Cunard | 248/370 |
| 5,326,326 | 7/1994 | Cunard et al. | 472/118 |

*Primary Examiner*—Kien T. Nguyen
*Attorney, Agent, or Firm*—Cesari and McKenna

[57] ABSTRACT

A children's swing ride is composed of an articulated seating platform having an axis of articulation. A pair of hangers is connected to the seating platform on opposite sides of that axis and a pair of levers extends from the platform on opposite sides of that axis. In use, the platform is suspended by way of the hangers from an overhead support so that riders sitting on opposite ends of the platform can swing back and forth and, by exerting force on the other rider's lever, cause articulation of the seating platform.

8 Claims, 3 Drawing Sheets

ARTICULATED SWING

FIELD OF THE INVENTION

This invention relates to a children's swing. It relates more particularly to a two-person swing whose seating platform has two degrees of freedom.

BACKGROUND OF THE INVENTION

Present day play gyms and swing sets come equipped with various different types of swing rides. The most common type consists simply of a flexible or rigid seat suspended from an overhead support by chains or other flexible hangers. There also exists so-called glide rides which comprise an elongated seating platform suspended from the overhead support by a pair of parallel rigid hangers pivotally connected to the platform at spaced apart locations thereon so as to form a planagram. When a pair of children sitting on opposite ends of the platform swing back and forth, the platform tends to remain more or less horizontal for small excursions of the swing. Therefore, the swing is quite safe and easy to use even by small children.

A variant of this type of swing, disclosed in U.S. Pat. No. 5,326,326, supports the seating platform by way of a pair of rockers pivoted to opposite ends of the platform and suspended from the overhead support by flexible hangers. This arrangement permits the children to manipulate the rockers to effect the motion of the swing. However, the motion of the seating platform and the children thereon is still confined to the usual back and forth motion. Therefore, some children may tend to loose interest in the swing after a relatively short time.

SUMMARY OF THE INVENTION

Accordingly it is an object of the present invention to provide an improved children's swing ride.

Another object of the invention is to provide a two-person swing whose seating platform has at least two degrees of freedom to hold the riders' interests.

Still another object of the invention is to provide a children's swing which can be operated in tandem by a pair of children so as to effect the motion of the swing seating platform.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, our swing comprises an articulated seating platform composed of a pair of platform sections which are pivotally connected or hinged together. The seating platform is suspended from an overhead support by a pair of hangers whose lower ends are connected to the two platform sections on opposite sides of the pivotal connection between those sections. Each platform section includes a generally horizontal seating portion for accommodating a child and a depending leg terminating in a foot rest which not only may support a foot of that child but which may support the opposite foot of the other child on the swing. In other words, each platform section provides a seating portion for one child and a foot rest for both children.

When the swing is at rest, the seating portions of the two platform sections are more or less horizontal as are the platform foot rests. When the swing is in motion, the seating platform swings back and forth in a manner similar to a conventional swing. However, with the present swing, the rider sitting on one platform section can use his or her foot resting on the foot rest of the other platform section to exert a force on that foot rest which tends to pivot the opposite platform section about its connection to the hanger thereby lifting up or "bumping" the opposite rider during the swing excursion. Thus, as the seating platform swings back and forth, both riders can use their feet, (i.e., one foot each) to move the seating portions of the other rider's platform section up and down so that the platform sections and the riders thereon have two degrees of freedom, i.e., the riders swing back and forth as they would on a typical swing ride and they may move up and down as they would on a standard seesaw or teeter totter.

The seating platform of the present swing may be constructed primarily of molded plastic parts which are relatively inexpensive to manufacture in quantity. Furthermore, those parts may be assembled quite easily without requiring any special tools. Therefore, the assembly can be left to the customer which further minimizes the initial cost of the swing.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF ILLUSTRATIVE EMBODIMENT

Figure 1:
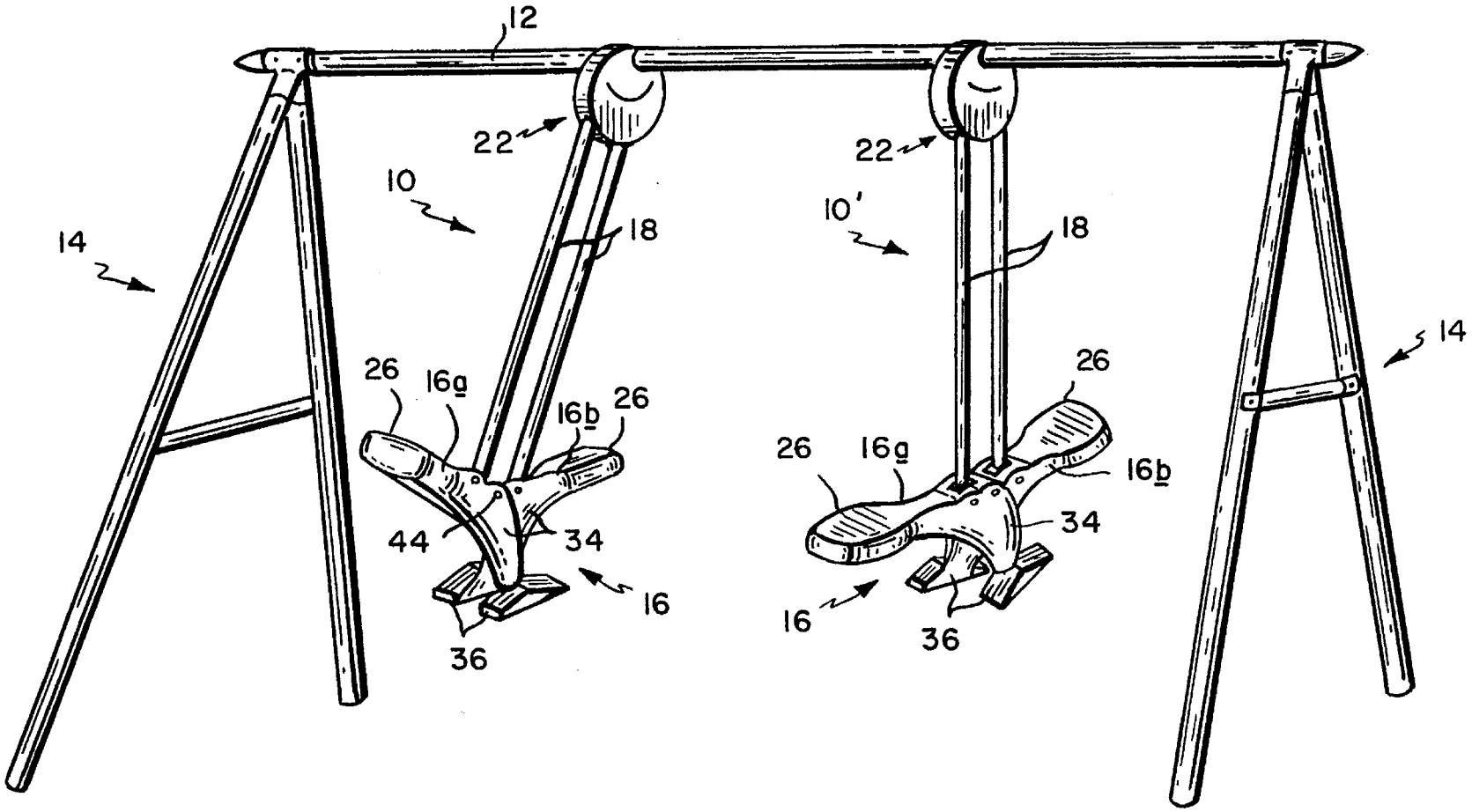
FIG. 1 is an isometric view of a swing set including two swing rides embodying the invention shown at different positions in the swing excursion.

Referring to FIG. 1 of the drawings, a pair of swings incorporating the invention is shown generally at 10 and 10'. Both swings are suspended from a crossbar 12 supported horizontally above the ground by a pair of similar A-frames 14 connected to opposite ends of the crossbar. Swings 10 and 10' are substantially identical but are shown at different positions in the swing excursion.

Each swing 10, 10' comprises a seating platform shown generally at 16 supported by a pair of spaced-apart hangers 18. In the illustrated swings, the hangers 18 are rigid metal tubes; however they could just as well be flexible hangers such as chains. The upper ends of hangers 18 are anchored to crossbar 12 by a conventional saddle-type bracket 22 such as the one described in U.S. Pat. No. 4,961,558, for example. As described in that patent, the hangers 18 may be pivotally connected to opposite ends of bracket 22 and hang down more or less parallel to one another. The lower ends of hangers 18 are pivotally connected to platform 16. Platform 16 is designed to support two children sitting on opposite ends of the platform facing each other.

Figure 3:
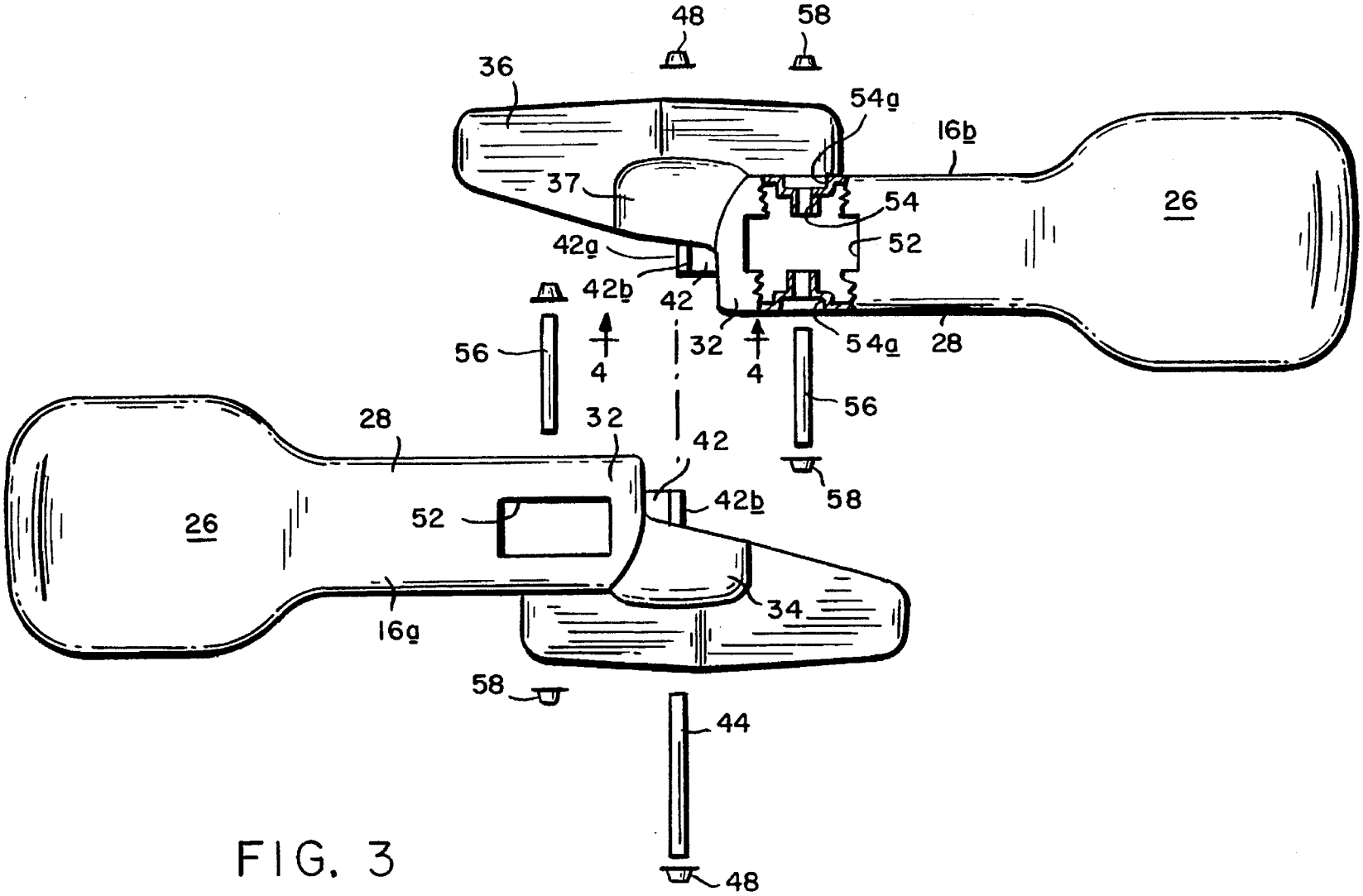
FIG. 3 is an exploded plan view, with parts broken away, of the seating platform of the FIGS. 1 and 2 swing rides.
Figure 2:
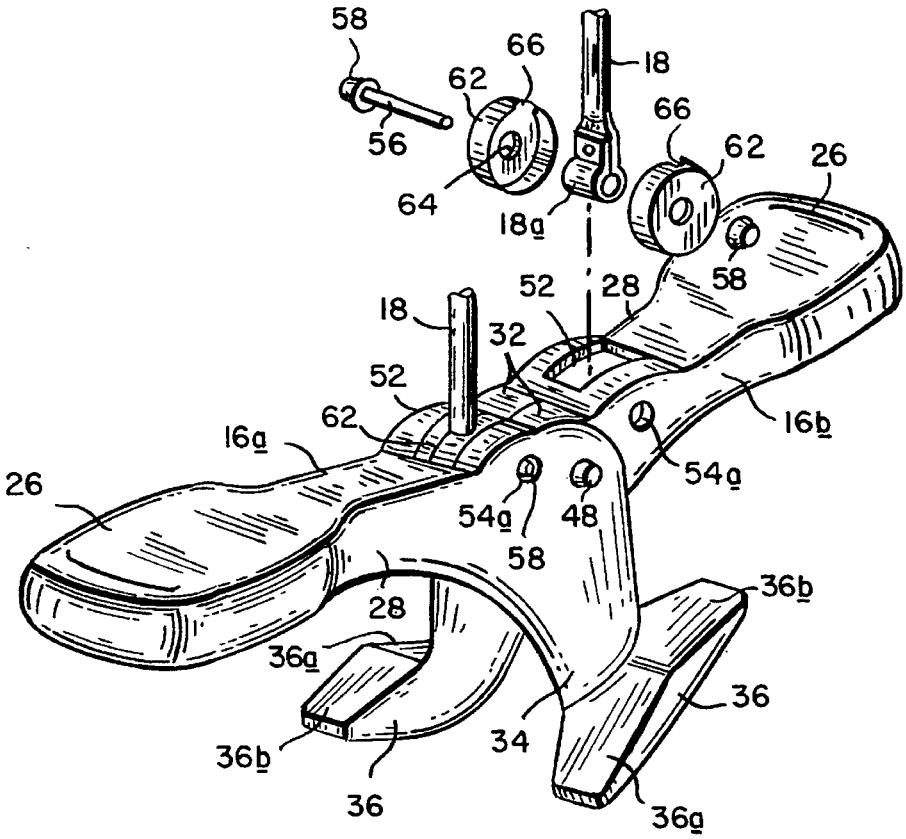
FIG. 2 is a fragmentary exploded isometric view, on a larger scale, showing certain elements of the FIG. 1 swing rides in greater detail.

Referring now to FIGS. 2 and 3, the seating platform 16 comprises a pair of substantially identical platform sections 16*a* and 16*b*. The platform sections are juxtaposed in reverse and pivotally connected together as shown in FIG. 2.

Each platform section 16*a*, 16*b* comprises a relatively wide, flat seating portion 26 which is joined by a narrower neck 28 to a rounded shoulder portion 32 which joins a generally vertical lever or leg 34 terminated at its lower end by a foot 36. The upper surface of foot 36 is beveled to form a pair of fore and aft inclined steps or foot rests 36*a* and 36*b* which slope away from one another.

Figure 4:
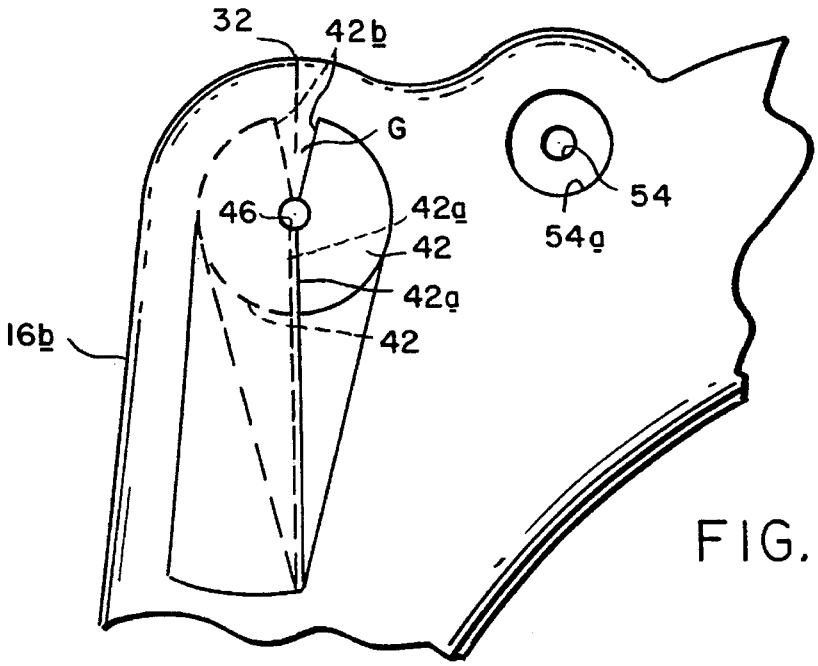
FIG. 4 is a fragmentary view taken along line 4—4 of FIG. 3 on a larger scale showing a part of the seating platform in greater detail.

As best seen in FIGS. 3 and 4, each platform section 16*a*, 16*b* is provided with a laterally extending boss 42. When the two platform sections are juxtaposed as shown in FIG. 2, the bosses 42 of the two sections are disposed side by side as shown in phantom in FIG. 4. The two platform sections are pivotally connected together by a pivot pin 44 which extends through registering lateral passages 46 in the shoulders 32 of the two platform sections right adjacent to bosses 42. The pivot pin is held in place by a pair of push caps 48 press fitted onto the ends of pivot pin 44 which project out on opposite sides of the platform 16.

As shown in FIG. 4, each boss 42 has a wall 42*a* that is perpendicular to the seating portion 26 of the corresponding platform section 16*a*, 16*b* and an inclined wall 42*b* so that when portion 26 is horizontal, the bosses occupy sectors of a cylinder which may extend from about six o'clock to about eleven and one o'clock, respectively. In other words, there is an angular gap G between the two inclined boss walls 42*b* of about 20° to 30°, 25° being illustrated. The vertical walls 42*a* of the bosses thus prevent the platform from articulating or folding downwards as would position the seating portions 26 thereof below pivot pin 44. However, the presence of the gap G allows the platform to fold upward about the pivot pin. More particularly, either (or both) platform sections 16*a*, 16*b* is free to pivot or swing upward about pivot pin 44 though an angle equal to the gap G. Of course, if both platform sections 16*a*, 16*b* are pivoted upward by the same amount, the pivoting motion for each section is limited to ½G, i.e., 12.5° in the illustrated swing.

Thus, the bosses 42 together function as a stop to limit the pivotal motions of platform sections 16*a*, 16*b* about the pivot pin to excursions that will not present a danger to children using the swing ride.

Referring to FIGS. 2 and 3, each platform section 16*a* and 16*b* is pivotally connected to one of the hangers 18. More particularly, a generally rectangular vertical recess or hole 52 is formed in each platform section shoulder 32. These holes are spaced from the passages 46 holding the pivot pin 44 toward the seating portions 26 of the two platform sections. Also, registering lateral passages 54 extend through the side walls of each platform section so as to intercept the hole 52 therein.

The lower end of each hanger 18 is flattened and bent to form an eye 18*a*. The hanger end is inserted into the hole 52 of the associated platform section 16*a* or 16*b* until the eye 18*a* is aligned with the corresponding passages 54. Then, a pivot pin 56 is inserted through the passages 54 and the eye 18*a*. The pivot pin 56 may be held in place by a pair of push caps 58 press fitted onto the ends of the pivot pin. Preferably, the passages 54 are provided with counterbores 54*a* at their outer ends to receive the push caps 58 so that the caps are recessed into the sides of platform 16.

Preferably, also, the lower end of each hanger 18 is sandwiched between a pair of mirror image cylindrical cups or shells 62 prior to connecting the hanger to the platform section. These cups are provided with axial holes 64 for receiving the associated pivot pin 56 and with notches 66 to provide clearance for the associated hanger 18 so that the cups will fit snugly within and fill the hole 52 of the associated platform section 16*a* or 16*b*. The cups thus permit the hangers 18 to pivot relative to the seating platform section 16, yet substantially close the holes 52, thus eliminating any pinch points at those locations.

When the two platform sections 16*a* and 16*b* are pivotally connected together and suspended from hangers 18 as shown in FIG. 1, it is obvious that the two sections are free to pivot relative to one another about the pivot pin 44 while the articulated platform 16 as a whole swings back and forth. Thus, when the swing is in use, a rider sitting on platform section 16*a* may push his or her foot down on the foot rest 36 of platform section 16*b*. The corresponding leg 34 then functions as a lever tending to pivot the latter platform section about its pivotal connection to hanger 18 thereby lifting up or "bumping" the rider sitting on that section 16*b*. In like manner, the rider sitting on section 16*b* can press against the foot rest 36 of platform section 16*a* thereby lifting up or "bumping" the rider sitting on section 16*a*. As the two riders swing back and forth, then, each rider can be moved up and down by the other rider so that the children may experience both a back and forth swing-type motion and also the vertical motion of a seesaw or teeter board.

As noted above, the platform sections 16*a* and 16*b* are substantially identical. They may be molded of inexpensive plastic material. Therefore, they are relatively inexpensive to make in quantity. Furthermore, the two sections 16*a* and 16*b* are easy to assemble so that the parts can be shipped in a knocked-down condition and assembled by the purchaser. If desired, for marketing purposes, the two sections 16*a* and 16*b* can be offered in different colors making the platform 16 particularly pleasing to the eye.

It will thus be seen that the objects set forth above, among those made apparent from the preceding description, are efficiently attained. Also, certain changes may be made in the above construction without departing from the scope of the invention. For example, instead of a depending foot rest, each platform section may be provided with an upstanding handle bar that projects toward and may be grasped by the rider on the other platform section. Thus, by pushing on that handle bar, one rider may "bump" the other rider while swinging as described above. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A children's swing ride comprising a seating platform including a first platform section, a second platform section, and pivot means pivotally connecting together said first and second platform sections so that said platform sections can pivot about a pivot axis, each platform section including a generally horizontal seating portion for supporting a child, and a lever extending from said seating portion beyond said pivot axis toward the other platform section so that said lever can be engaged by a child supported by the other platform section, first elongated hanger means having opposite ends;

second elongated hanger means having opposite ends;

first connecting means connecting one end of said first hanger means to said first platform section;

second connecting means connecting one end of the second hanger means to said second platform section, said first and second connecting means being spaced on opposite sides of said pivot axis, and suspension means connected to the other ends of said first and second hanger means supporting said hanger means and said seating platform above the ground.

2. The swing ride defined in claim 1 and further including means limiting the pivotal motion of the said first and second platform sections about said pivot axis.

3. The swing ride defined in claim 1 wherein said first and second hanger means comprise a pair of substantially parallel, rigid tubes, and said first and second connecting means are pivotal connections.

4. The swing ride defined in claim 1 wherein the lever of each platform section depends from that platform section and extends under the seating portion of the other platform section.

5. The swing ride defined in claim 1 wherein the seating portions of said first and second platform sections are located on the opposite sides of said first and second hanger means from said pivot means.

6. A children's swing ride comprising an articulated seating platform having an axis of articulation;

a pair of hangers having corresponding first ends connected to said platform on opposite sides of said axis;

a pair of levers extending from said platform on opposite sides of said axis by which the platform can be articulated by children sitting on the platform, and means limiting the articulation of said platform to upward folding of said platform.

7. The children's swing ride defined in claim 6 and further including means for suspending said platform above the ground by way of said hangers.

8. The swing ride defined in claim 6 wherein said limiting means limits the articulation to up to 30°.

* * * * *